US006589622B1

(12) United States Patent
Scott

(10) Patent No.: US 6,589,622 B1
(45) **Date of Patent: *Jul. 8, 2003**

(54) RESEALABLE LABEL FLAP INCLUDING TAMPER EVIDENT TAB

(75) Inventor: Barry M. Scott, West Bend, WI (US)

(73) Assignee: Prime Label & Screen, Inc., Pewaukee, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/460,684

(22) Filed: Dec. 14, 1999

(51) Int. Cl.[7] ..... B65D 75/52

(52) U.S. Cl. ..... 428/40.1; 206/807; 283/81; 428/41.6; 428/41.7; 428/41.9; 428/42.1; 428/42.2; 428/42.3; 428/43; 428/914; 428/915

(58) Field of Search ..... 428/40.1, 41.6, 428/41.7, 41.9, 42.1, 42.2, 42.3, 43, 914, 915; 283/81; 206/807

(56) References Cited

U.S. PATENT DOCUMENTS

| | | | | | |
|---|---|---|---|---|---|
| 4,082,873 | A | | 4/1978 | Williams | 428/40 |
| 4,180,929 | A | | 1/1980 | Schultz, Jr. | 40/2.2 |
| 4,483,018 | A | * | 11/1984 | Whelan | 229/81 |
| 4,537,327 | A | * | 8/1985 | Lu | 220/359 |
| 4,608,288 | A | | 8/1986 | Spindler | 428/78 |
| 4,652,473 | A | | 3/1987 | Han | 428/35 |
| 4,679,693 | A | * | 7/1987 | Forman | 206/610 |
| 4,709,397 | A | | 11/1987 | Voshall et al. | 383/5 |
| 4,998,666 | A | | 3/1991 | Ewan | 229/102 |
| 5,294,470 | A | | 3/1994 | Ewan | 428/40 |
| 5,449,538 | A | * | 9/1995 | Denny | 428/40.1 |
| 5,551,729 | A | | 9/1996 | Morgan | 283/94 |
| 5,582,887 | A | | 12/1996 | Etheredge | 428/41.5 |
| 5,658,411 | A | | 8/1997 | Faykish | 156/233 |
| 5,683,774 | A | | 11/1997 | Faykish et al. | 428/40.1 |
| 5,770,283 | A | | 6/1998 | Gosselin et al. | 428/35.7 |

* cited by examiner

*Primary Examiner*—Nasser Ahmad
(74) *Attorney, Agent, or Firm*—Andrus, Sceales, Starke & Sawall, LLP

(57) ABSTRACT

A resealable label flap including a tamper indicating tab that remains in contact with the package body to indicate that the label flap has been removed from the package body. The label flap includes a main body portion having a first adhesive applied to its bottom face surface. The first adhesive is a removable adhesive that allows the label flap to be repeatedly removed and reapplied to the package body. The label flap further includes a starting tab that does not adhere to the top surface of the package body. A tamper indicating tab is formed as part of the starting tab and includes the first adhesive applied to its bottom face surface. The tamper indicating tab is defined by a series of perforations such that when the label flap is initially removed from the product package, the tamper indicating tab separates from the starting tab along the perforations to indicate that the product package has been opened. The first adhesive applied to the bottom surface of the tamper indicating tab creates an adhesive bond with the package body that is stronger than the material between the perforations defining the tamper indicating tab such that the tamper indicating tab separates from the remaining portions of the label flap.

12 Claims, 3 Drawing Sheets

FIG. 1
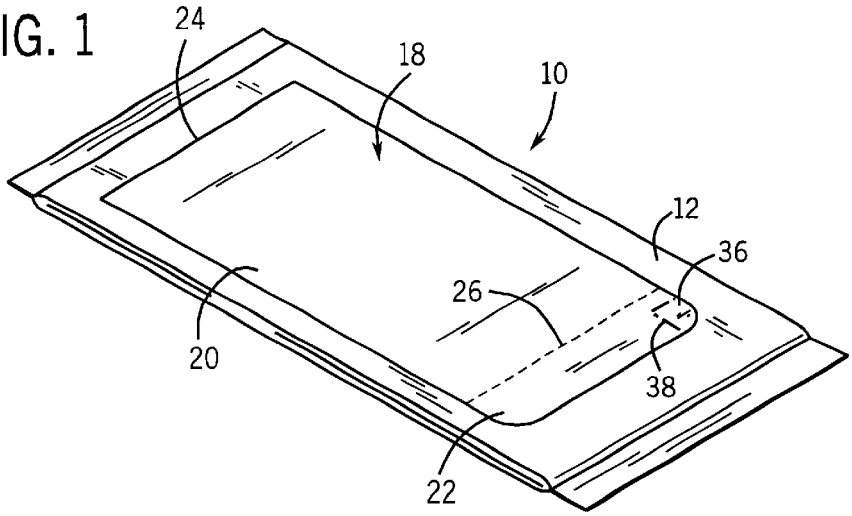
FIG. 2
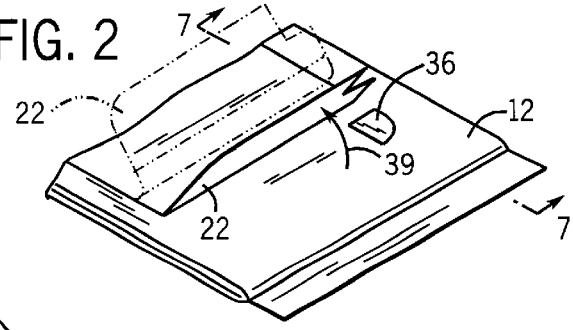
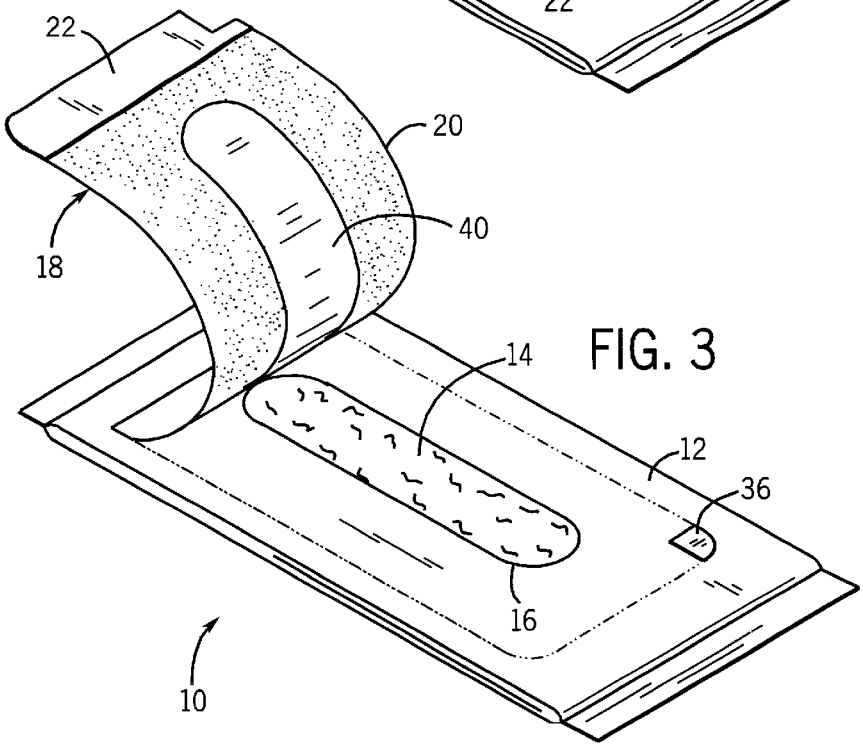
FIG. 3

RESEALABLE LABEL FLAP INCLUDING TAMPER EVIDENT TAB

BACKGROUND OF THE INVENTION

The present invention relates to a resealable label flap positionable to cover an opening in a product package containing removable articles such that the label flap can be repeatedly removed and reapplied to access the articles contained within the package. More specifically, the present invention relates to a resealable label flap that includes a tamper evident tab that separates from the remaining portions of the label flap and remains attached to the product package after the label flap is removed from the product package for the first time.

Resealable label flaps are commonly used with product packages that include packaged sheet-like removable articles that have been thoroughly wetted with a liquid prior to packaging. The product package is generally constructed from a thin, liquid impervious material that has an opening over which the label flap is removably adhered. Typically, the label flap is a strip of flexible or semi-rigid thermoplastic material having a removable pressure-sensitive adhesive applied to one surface of the label. The removable adhesive creates a generally air-tight seal around the package opening to prevent the packaged removable articles from drying out during storage.

Since resealable label flaps can be continuously removed and reapplied to the product package containing removable articles without any indication that the product package has been previously opened, a need has arisen for a resealable label flap that provides an indication that the product package has been opened and subsequently resealed. Particularly, a need exists for such a tamper evident resealable label flap in the medical field, since once the product package has been opened, the contents of the product package may no longer be sterile.

Therefore, it is an object of the present invention to provide a resealable label flap that includes means for indicating whether the label flap has previously been removed from the product package. It is an additional object of the invention to provide a resealable label flap that includes a tamper indicating tab formed on the label flap that separates from the label flap and remains attached to the product package when the label flap is initially removed from the package. It is a further object of the present invention to position the tamper indicating tab on the starting tab of the label flap such that the tamper indicating tab separates from the label flap prior to the label flap being pulled past the opening of the product package, thereby preventing the label flap from being partially opened to access the removable articles contained within the product package. Additionally, it is an object of the present invention to provide an easily constructed, tamper evident resealable label flap that can be used in connection with a product package to accurately indicate whether the product package has been previously opened.

SUMMARY OF THE INVENTION

The present invention is a resealable label flap that can be positioned to cover an opening in a product package. The resealable label flap includes a main body portion extending between a first end and a second end. The main body portion includes a generally smooth top surface and a bottom surface including a layer of a first adhesive. A first adhesive is applied over the entire bottom surface of the main body portion and is a removable pressure-sensitive adhesive that retains its adhesive properties following repeated removal and reapplication of the main body portion to the package body.

The label flap further includes a starting tab integrally formed with the main body portion and positioned adjacent to the first end of the main body portion. Like the main body portion, the starting tab includes a top surface and a bottom surface. The bottom surface of the starting tab includes the first adhesive and a masking layer applied on top of the first adhesive. The masking layer applied on top of the first adhesive neutralizes the first adhesive such that the starting tab does not adhere to the package body.

The label flap further includes a tamper indicating tab formed as part of the starting tab. The tamper indicating tab is formed near the outer edge of the starting tab and is defined by a series of perforations such that the tamper indicating tab can be separated from the remaining portion of the starting tab. The tamper indicating tab also includes a top surface and a bottom surface.

The tamper indicating tab includes the first adhesive applied to its bottom surface. When the label flap is applied to the package body, the layer of the first adhesive applied to the bottom surface of the tamper indicating tabs forms an adhesive bond between the tamper indicating tab and the top surface of the package body. In accordance with the invention, the adhesive bond between the first adhesive applied to the bottom surface of the tamper indicating tab and the top surface of the package body is stronger than the material between the perforations defining the tamper indicating tab such that when the label flap is removed from the package body, the tamper indicating tab separates from the remaining portions of the starting tab.

Once the tamper indicating tab has been separated from the starting tab, the tamper indicating tab remains in contact with the top surface of the package body and indicates that the label flap has been removed from the package body. In the preferred embodiment of the invention, the tamper indicating tab is formed in a portion of the starting tab such that the tamper indicating tab separates from the starting tab prior to the label flap being pulled past the opening in the package body that provides access to the removable articles contained within the package body. Additionally, in another feature of the invention, the tamper indicating tab is colored different from the package body such that the contrast between the colors of the tamper indicating tab and the package body clearly indicate that the label flap has been previously removed from the package body.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 1 is a perspective view of a package containing removable articles, including a tamper evident resealable label flap of the present invention;

FIG. 2 is a partial perspective view illustrating the partial removal of the label flap from the package and the separation of a tamper indicating tab from the label flap;

FIG. 3 is a perspective view illustrating the package with the resealable label flap in the open position permitting removal of the contained articles;

DETAILED DESCRIPTION OF THE INVENTION

Figure 4:
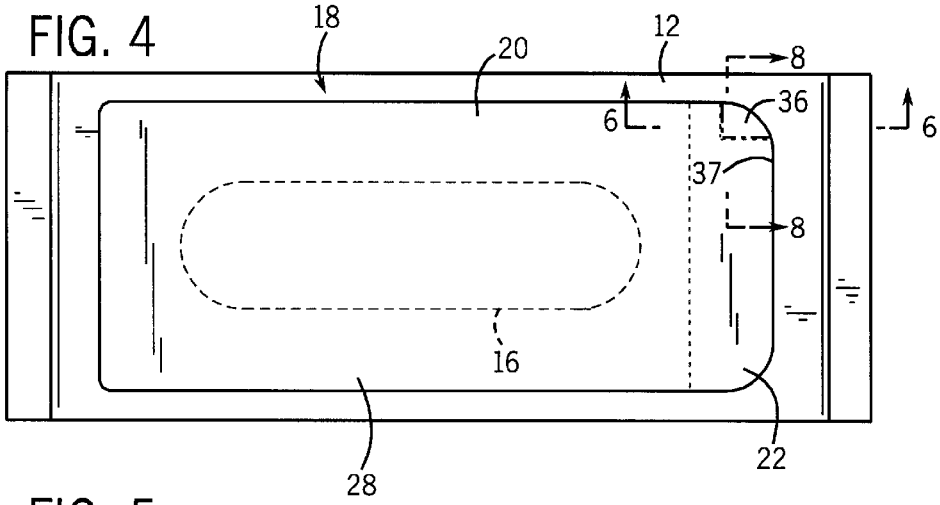
FIG. 4 is a top view of the package including the tamper evident resealable label flap.

FIGS. 1 and 3 generally illustrate a resealable product package 10 having a main package body 12 formed from a cylinder of liquid-impervious, flexible thermoplastic material heat sealed on each end to define an internal space for housing the removable articles contained within the product package 10. In the embodiment of the invention illustrated in FIGS. 1 and 3, the contents of the product package 10 comprise a series of stacked, individual cleansing cloths 14 that can be impregnated with appropriate cleaning solutions. For example, the cleansing cloths 14 could be wetted baby wipes or hand towels.

The package body 12 includes an opening 16 through the package body to provide access to the internal space of the package body 12 containing the cleansing cloths 14. As can be readily understood, the individual cleansing cloths 14 can be removed from the internal space defined by the package body through the opening 16.

The product package 10 further includes a removable label flap 18 that is applied to the package body 12 to seal the package body 12 by covering the opening 16. The label flap 18 contacts the generally smooth, flat top surface of the package body 12 and forms a generally water- and air-tight seal with the package body 12 around the opening 16. The water- and air-tight seal around the opening 16 prevents contamination of the cleansing cloths 14 and prevents the cleansing cloths 14 from drying out.

The label flap 18 is resealably attached to the upper surface of the package body 12 such that the label flap 18 can be repeatedly opened and resealed to provide access to the cleansing cloths 14 contained within the internal space defined by the package body 12. The label flap 18 includes a main body portion 20 and a starting tab 22. The main body portion 20 extends between a first end 24 and a second end 26. The second end 26 of the main body portion 20 is integrally formed with the starting tab 22 such that the main body portion 20 and the starting tab 22 can be formed from a single, unitary piece of material. In the preferred embodiment of the invention, the entire label flap 18, including the main body portion 20 and the starting tab 22 is a two layer construction having a base layer of white polyethylene covered by a top layer of adhesively coated clear polypropylene. In the Figures of the present invention, the label flap 18 is illustrated as a unitary structure, although it should be understood that the label flap is actually formed from the two layers of material identified above.

Figure 5:
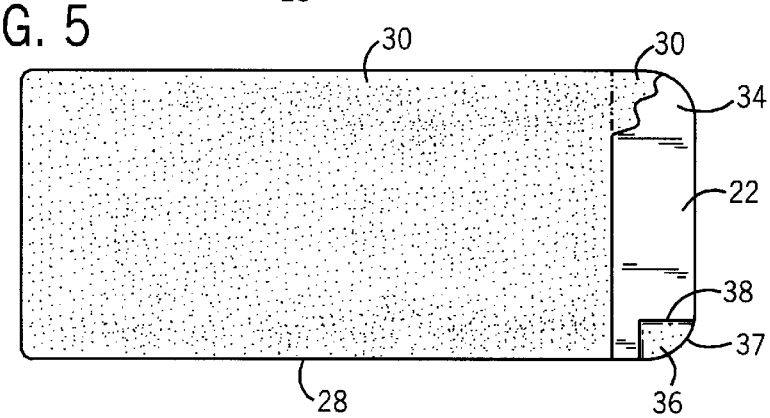
FIG. 5 is a back view of the tamper evident resealable label flap of the present invention.

As can be seen in FIGS. 4 and 5, the label flap 18, including both the main body portion 20 and the starting tab 22, include a generally smooth top surface 28 and a generally smooth bottom surface 30. As discussed above, the combined thickness of the label flap 18 is approximately 0.005 inches. The bottom surface 30 of the entire label flap 18, including both the main body portion 20 and the starting tab 22, includes a first adhesive 32. In the preferred embodiment of the invention, the layer of the first adhesive 32 applied to the bottom surface 30 of the entire label flap 18 is a pressure-sensitive adhesive that retains its adhesive qualities as the label flap 18 is repeatedly peeled from the package body 12 and reapplied thereto. The first adhesive 32 has the desired adhesive properties to form a seal around the opening 16 while being able to be pulled from the package body 12 without damaging the thermoplastic material forming the package body 12.

In the preferred embodiment of the invention, the entire label flap 18, including the first adhesive 32, is commercially available from Flexcon, Inc., Spencer, Mass., as product number PE380FWM/V-29/50KQ-8. In the embodiment of the invention shown, the first adhesive 32 is a V-29 removable adhesive having a surface thickness of approximately 0.0007 inches.

The starting tab 22 is a portion of the label flap 18 in which the first adhesive 32 is rendered ineffective or, in an alternative, not present such that the starting tab 22 can be grasped by the user to pull the label flap 18 from the package body 12. In the preferred embodiment of the invention, the starting tab 22 includes a masking layer 34 applied over the layer of first adhesive 32 to render the first adhesive 32 ineffective and thus form the starting tab 22. After the masking layer 34 has been applied to the starting tab 22, the starting tab 22 is no longer adhesive and thus does not adhere to the top surface of the product package 12.

Referring now to FIGS. 4 and 5, the label flap 18 of the present invention further includes a tamper indicating tab 36 along an outer edge of the starting tab 22. As can best be seen in FIG. 1, the tamper indicating tab 36 extends inward from the outer edge 37 and is defined along the starting tab 22 by a series of perforations 38. The perforations 38 extend through the thickness of the starting tab 22 and weaken the material forming the starting tab 22 along the outer edge of the tamper indicating tab 36.

Figure 6:
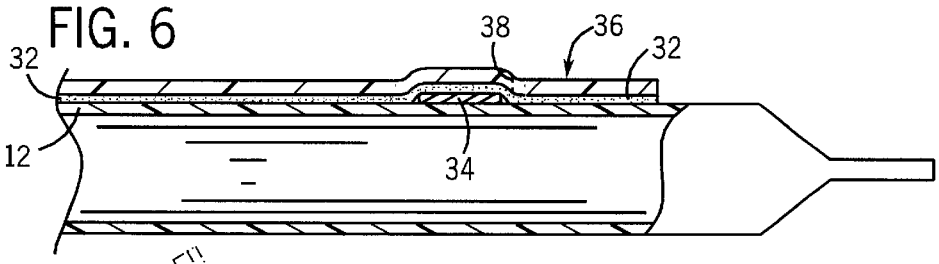
FIG. 6 is a partial section view taken along line 6—6 of FIG. 4 illustrating the tamper indicating tab of the resealable label flap.

Referring now to FIGS. 5 and 6, the bottom surface of the tamper indicating tab 36 includes the first adhesive 32. Specifically, the tamper indicating tab 36 does not include the masking layer 34 that is applied to the remaining portions of the starting tab 22. Thus, the first adhesive 32 is exposed to the top surface of the package body 12 when the label flap 18 of the present invention is positioned in contact with the package body 12. In the preferred embodiment of the invention, the strength of the material between the perforations 38 defining the tamper indicating tab 36 is weaker than the strength of the adhesive bond created between the first adhesive 32 formed on the back surface of the tamper indicating tab 36 and the top surface of the package body 12. Thus, when the label flap 18 is initially removed from the package body 12, as will be discussed in greater detail below, the perforations 38 defining the tamper indicating tab 36 tear and allow the tamper indicating tab 36 to separate from the remaining portion of the label flap 18 and remain in contact with the top surface of the package body 12.

The formation of the label flap 18 of the present invention will now be described. Initially, a base material including the first adhesive 32 and a releasable liner (not shown) is unwound from a supply source. The base material including the first adhesive 32 is separated from the releasable liner and the masking layer 34 is applied to the first adhesive 32 at a location corresponding to the starting tab 22. The masking layer 34 is applied to the entire starting tab 22 except for the location corresponding to the tamper indicating tab 36. Thus, the first adhesive 32 contained on the back surface of the tamper indicating tab 36 retains its adhesive properties. With the starting tab 22 formed, the releasable liner is again reapplied to the base material including the first adhesive 32.

After the starting tab 22 has been formed, a desired graphic image can be printed on the base material if desired. Following the printing of the graphic image, a transparent top layer of polypropylene (not shown) is laminated to the top surface of base material. The top layer of polypropylene protects the graphic image printed on the top surface of the base material. Once the top layer has been laminated to the base material, the perimeter for the label flap is die cut to create the desired shape for the label flap 18. At the same time, the perforations 38 are die cut into the label flap to define the tamper indicating tab 36. Perforations 38 pass through both the base material and transparent top layer such that the tamper indicating tab 36 can be separated from the entire label flap 18.

Referring now to FIG. 1, after the package body 12 has been formed and filled with removable articles, the label flap 18 is applied to the top surface of the package body 12 as illustrated. When the label flap 18 is initially applied, the tamper indicating tab 36 is connected to the starting tab 22. As can be seen in FIG. 4, when the label flap 18 is applied to the top surface of the package body 12, the starting tab 22 extends past the opening 16 to the package body 12.

When a user desires to access the cleansing cloths 14 contained within the package body 12, the user first grasps the starting tab 22. As previously discussed, the starting tab 22 includes the masking layer 34 such that the starting tab does not adhere to the top surface of the package body 12. However, the tamper indicating tab 36 includes the first adhesive 32, such that the tamper indicating tab 36 is adhesively attached to the top surface of the package body 12.

Figure 7:
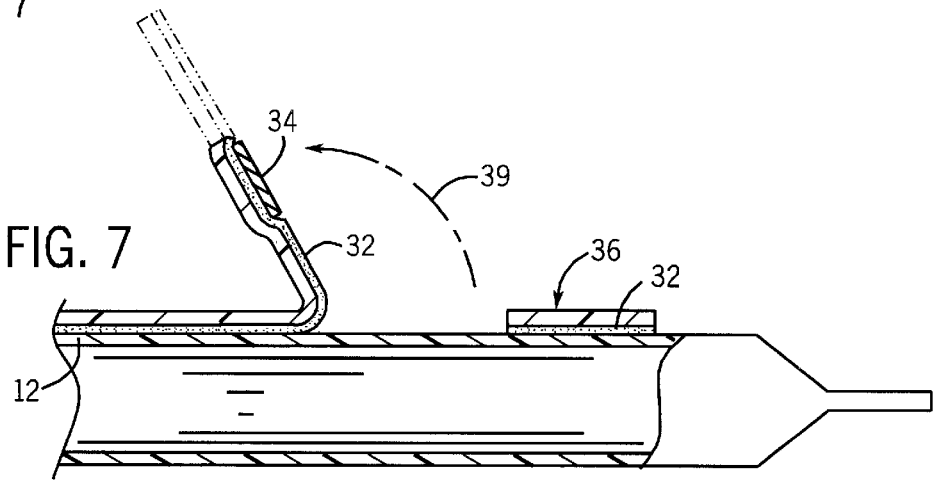
FIG. 7 is a partial section view taken along line 7—7 of FIG. 2 illustrating the separation of the tamper indicating tab as the label flap is removed from the package.
Figure 8:
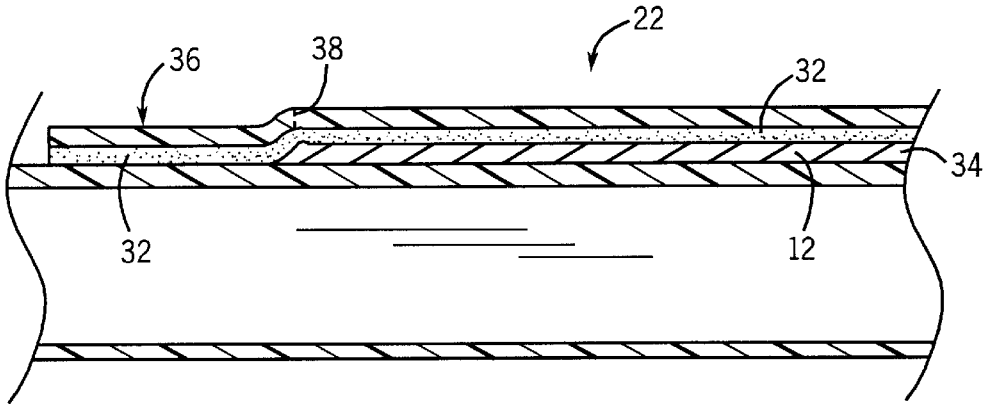
FIG. 8 is a partial section view taken along line 8—8 illustrating the label flap and tamper indicating tab of the present invention.

Once the starting tab 22 has been grasped, the user pulls back on the label flap 18 as indicated by arrow 39 in FIGS. 2 and 7. As the user pulls back on the starting tab 22, the adhesion force between the first adhesive 32 on the back surface of the tamper indicating tab 36 causes the tamper indicating tab 36 to separate from the starting tab 22 along the perforations 38 and remain attached to the top surface of the package body 12. As can be seen in FIG. 2, the tamper indicating tab 36 separates from the starting tab 22 prior to the label flap 18 uncovering the opening 16 contained in the package body 12.

Once the starting tab 22 has been grasped and the tamper indicating tab 36 separated, the user continues to pull back on the label flap 18 to overcome the removable adhesive bond between the removable first adhesive 32 and the package body 12. The user continues to pull back on the label flap 18 until the entire main body portion 20 has been pulled out of contact from the package body 12.

As shown in FIG. 3, the first time the label flap 18 is pulled from the package body 12, a die cut oval covering 40 separates from the package body 12 to define the opening 16. The oval covering 40 remains adhesively attached to the label flap 18 and prevents contact between the first adhesive 32 and the cleaning cloths 14.

After the desired number of cleaning cloths 14 have been removed from the opening 16, the user repositions the label flap 18 over the opening 16. The first adhesive 32 contained on the main body portion 20 reseals the label flap 18 onto the package body 12 to form the required air-tight seal around the opening 16.

In accordance with the invention, however, the tamper indicating tab 36 is permanently separated from the remaining portion of the label flap 18 after the product package 10 has been opened for the first time. Thus, the separation of the tamper indicating tab 36 indicates that the product package 10 has been previously opened.

In the preferred embodiment of the invention, the tamper indicating tab 36 is formed as part of the starting tab 22. In this manner, the tamper indicating tab 36 is separated from the starting tab 22 prior to the user accessing the contents of the product package 10. Therefore, it would be impossible to partially remove the label flap 18 to gain access to the removable articles without separating the tamper indicating tab 36 from the label flap 18. Although the tamper indicating tab 36 is preferably formed as part of the starting tab 22, it is contemplated by the inventors that the tamper indicating tab 36 could be positioned along other portions of the label flap 18 to indicate that the label flap 18 has been removed from the package body 12.

In the preferred embodiment of the invention, the tamper indicating tab 36 is preferably of a different color than the package body 12 such that the tamper indicating tab 36 stands out when separated from the label flap 18, as illustrated in FIG. 2.

Although the present invention has been defined as including a specific type of adhesive 32 applied to the back surface of the main body portion 20 and tamper indicating tab 36, it should be understood that a critical feature of the invention is that the first adhesive 32 applied to the tamper indicating tab 36 creates a stronger bond to the package body 12 than the strength of the material between the perforations 38 that define the tamper indicating tab 36. The greater strength of the adhesive bond between the tamper indicating tab 36 as compared to the strength of the perforations 38 allow the tamper indicating tab 36 to be separated from the label flap 18 as the label flap 18 is pulled from the package body 12.

Various alternatives and embodiments are contemplated as being within the scope of the following claims particularly pointing out and distinctly claiming the subject matter regarded as the invention.

I claim:

1. A tamper evident resealable label flap positionable to cover an opening in a package containing removable articles, the label flap comprising:

a main body portion extending between a first end and a second end and sized to cover the opening in the package, the main body portion having a top surface and a bottom surface, the bottom surface of the main body portion including a first adhesive that creates a substantial seal around the opening in the package and that permits repeated application and removal of the main body portion from the package;

a starting tab integrally formed with the first end of the main body portion, the starting tab having a top surface and a bottom surface, the bottom surface of the starting tab being non-adhesively positionable in contact with the package; and a tamper indicating tab formed as a portion of the starting tab, the tamper indicating tab including a top surface and a bottom surface, the bottom surface of the tamper indicating tab including the first adhesive to secure the tamper indicating tab to the package such that as the label flap is pulled from the package for the first time, the tamper indicating tab separates from the starting tab and remains attached to the package, wherein the tamper indicating tab is integral with and substantially undistinguishable from the starting tab before the label flap has been pulled from the package, wherein the tamper indicating tab separates from the starting tab as the label flap is pulled from the package for the first time such that the shape of the starting tab is modified.

2. The label flap of claim 1 wherein the tamper indicating tab separates from the starting tab before the main body portion is removed from the package to expose the opening.

3. A tamper evident resealable label flap positionable to cover an opening in a package containing removable articles, the label flap comprising:

a main body portion extending between a first end and a second end and sized to cover the opening in the package, the main body portion having a top surface and a bottom surface, the bottom surface of the main body portion including a first adhesive that permits repeated application and removal of the main body portion from the package;

a starting tab integrally formed with the first end of the main body portion, the starting tab having a top surface and a bottom surface, the bottom surface of the starting tab being non-adhesively positionable in contact with the package; and a tamper indicating tab formed on a portion of the starting tab, the tamper indicating tab including a top surface and a bottom surface, the bottom surface of the tamper indicating tab including the first adhesive to secure the tamper indicating tab to the package such that as the label flap is pulled from the package for the first time, the tamper indicating tab separates from the starting tab and remains attached to the package, wherein the tamper indicating tab is integral with and substantially undistinguishable from the starting tab before the label flap has been pulled from the package, wherein the tamper indicating tab separates from the starting tab as the label flap is pulled from the package for the first time such that the shape of the starting tab is modified, wherein the bottom surface of the starting tab includes the first adhesive and a masking layer covering the first adhesive to prevent adhesion between the starting tab and the package.

4. The label flap of claim 3 wherein the masking layer is positioned over the first adhesive along the entire starting tab except for a portion of the starting tab that defines the tamper indicating tab.

5. The label flap of claim 1 wherein the tamper indicating tab is defined by a series of perforations formed in the starting tab such that the tamper indicating tab separates from the starting tab along the perforations.

6. A resealable package comprising:

a flexible package body having an internal space sized to contain a plurality of removable articles;

an elongated opening through the package body to the internal space for accessing the removable articles; and a resealable label flap positioned on the flexible package to cover the opening in the package, the label flap comprising:

a main portion extending between a first end and a second end and sized to cover the opening in the package, the main body portion having a top surface and a bottom surface, the bottom surface of the main body portion including a first adhesive that creates a substantial seal around the opening in the package and permits repeated application and removal of the main body portion from the package;

a starting tab integrally formed with the first end of the main body portion, the starting tab having a top surface and a bottom surface, the bottom surface of the starting tab being non-adhesively positionable in contact with the package; and a tamper indicating tab formed as a portion of the label flap, the tamper indicating tab including a top surface and a bottom surface, the bottom surface of the tamper indicating tab including the first adhesive to secure the tamper indicating tab to the package such that as the label flap is pulled from the package for the first time, the tamper indicating tab separates from the label flap and remains attached to the package, wherein the tamper indicating tab is integral with and substantially undistinguishable from the label flap until the label flap has been pulled from the package and the tamper indicating tab has been separated from the label flap.

7. The label flap of claim 6 wherein the tamper indicating tab separates from the label flap before the main body portion is removed from the package to expose the opening.

8. A resealable package comprising:

a flexible package body having an internal space sized to contain a plurality of removable articles;

an elongated opening through the package body to the internal space for accessing the removable articles; and a resealable label flap positioned on the flexible package to cover the opening in the package, the label flap comprising:

a main portion extending between a first end and a second end and sized to cover the opening in the package, the main body portion having a top surface and a bottom surface, the bottom surface of the main body portion including a first adhesive that permits repeated application and removal of the main body portion from the package;

a starting tab integrally formed with the first end of the main body portion, the starting tab having a top surface and a bottom surface, the bottom surface of the starting tab being non-adhesively positionable in contact with the package; and a tamper indicating tab formed as a portion of the label flap, the tamper indicating tab including a top surface and a bottom surface, the bottom surface of the tamper indicating tab including the first adhesive to secure the tamper indicating tab to the package such that as the label flap is pulled from the package for the first time, the tamper indicating tab separates from the label flap and remains attached to the package, wherein the tamper indicating tab is integral with and substantially undistinguishable from the label flap until the label flap has been pulled from the package and the tamper indicating tab has been separated from the label flap, wherein the bottom surface of the starting tab includes the first adhesive and a masking layer covering the first adhesive to prevent adhesion between the starting tab and the package.

9. The label flap of claim 8 wherein the tamper indicating tab is formed on a portion of the starting tab.

10. The label flap of claim 9 wherein the masking layer is positioned over the first adhesive along the entire starting tab except for a portion of the starting tab that defines the tamper indicating tab.

11. The label flap of claim 6 wherein the tamper indicating tab is defined by a series of perforations formed in the label flap such that the tamper indicating tab separates from the label flap along the perforations.

12. The label flap of claim 11 wherein the tamper indicating tab is formed on a portion of the tamper indicating tab.

* * * * *